US005515544A

United States Patent [19]

Hosking

[11] Patent Number: 5,515,544

[45] Date of Patent: May 14, 1996

[54] METHOD FOR CONJOINING CLOTHES

[76] Inventor: Louis R. Hosking, 4575 W. 80th St. Cir., No. 223, Bloomington, Minn. 55437

[21] Appl. No.: 380,623

[22] Filed: Jan. 30, 1995

[51] Int. Cl.[6] ..... A41F 17/00; A41D 27/00

[52] U.S. Cl. ..... 2/107; 2/112; 2/117; 2/223; 450/110; 24/304

[58] Field of Search ..... 2/107, 112, 117, 2/223, 323; 450/81, 112, 109, 110; 24/DIG. 11, 304

[56] References Cited

U.S. PATENT DOCUMENTS

| | | | |
|---|---|---|---|
| 1,469,858 | 10/1923 | Van Heusen | 2/117 X |
| 2,030,135 | 2/1936 | Carpenter | 450/81 |
| 2,292,024 | 8/1942 | Dreher | 450/81 |
| 3,453,888 | 7/1969 | Perry | 428/124 |
| 4,621,442 | 11/1986 | Mack | 428/130 X |
| 4,726,972 | 2/1988 | Instance | 428/130 X |
| 5,230,944 | 7/1993 | Beer et al. | 428/40 X |
| 5,266,371 | 11/1993 | Sugii et al. | 428/40 |
| 5,270,088 | 12/1993 | Grasse | 428/40 |

*Primary Examiner*—Jeanette E. Chapman

[57] ABSTRACT

A method of making and using a removable clothing conjoiner to attach the waistband of a pants or skirt to a user's shirt or blouse. The method takes a material which is made or dimensioned to be stiffer in one direction than the other and cuts the material so as to place that stiffer direction vertically, thereby preventing rolling, folding, or bunching of the material during use while allowing flexibility in the horizontal direction for wearer comfort. The base is coated with adhesive, and the adhesive is covered by removable liners which the user peels off when applying the conjoiner to his/her clothing.

5 Claims, 2 Drawing Sheets

METHOD FOR CONJOINING CLOTHES

BACKGROUND OF THE INVENTION

Some men, especially those of large girth or with a paunch, experience the disconcerting feeling of their trousers sliding down their stomach and the sloppy bunching of the trousers over their shoes. The unbecoming result is an accentuated protruding stomach. Others, while wearing a suit or shirt and trousers, experience their shirt pulling or twisting out during the course of normal activities throughout the day. Again, the result is an unkempt appearance with the shirt forming a baggy bulge at the belly. Women also experience this slippage problem due to stretching and twisting motions in normal every day activities while wearing a blouse and skirt or slacks.

There are disadvantages with some methods and means currently being used. Belts are of no help for beltless-style trousers or for men with protruding abdomens. Belts do not stop shirts from pulling or twisting out from belt-style trousers. Suspenders can cause discomfort by pulling trousers up too far. They also add another cause to the problem of shirts pulling out. Buttons are bulky and not feasible for many combinations of clothing. A butterfly bandage shaped adhesive strip as shown in U.S. Pat. No. 3,947,896 lacks sufficient vertical rigidity and fails to lock the garment in both horizontal and vertical directions.

For the foregoing reasons there is a need for an article that can join separate and distinct articles of clothing to ameliorate or eliminate some of the problems previously mentioned.

For many years, the inventor has been experimenting with different methods for making clothing conjoiners to solve these problems. Originally, strips of ordinary double-backed tape were tried, but within a few hours of use they would roll into an ineffective wad of adhesive material. It wasn't until the method employed a backing which was relatively stiff in the vertical direction and relatively flexible in the horizontal direction that a successful product was made. The current invention employs a backing which, being relatively stiff in the vertical direction, will not fold, roll, or bunch while being worn between the waistband of pants or skirts and a shirt or blouse. The method's use of backing which is relatively flexible in the horizontal direction permits the body movement which is necessary for comfortable wearing of pants or skirts.

SUMMARY OF THE INVENTION

This invention relates generally to a method for conjoining clothes, and more particularly to a method for making and using clothing fasteners which have an adhesive attachment assembly and liners.

An object of the present invention is to provide a method for making and using a fastener to help keep trousers or skirts from slipping down one's stomach. Another object is to provide a method for making and using a fastener to control the amount of shirt or blouse which can pull out from trousers, slacks or skirt in order to present a neat appearance throughout the day. A further object of the invention is the making of a means to convert separate articles of apparel, such as a shirt and pants, into a single unitary outfit. For example, the invention can give a shirt and trousers the characteristics of a jumpsuit. The invention allows the shirt or blouse to hold trousers or a skirt in the desired vertical position while the weight of the trousers or skirt pull down and straighten out the shirt or blouse.

According to the present invention, the foregoing and other objects are attained by making a clothing conjoiner to be used between two articles of clothing.

The invention calls for dimensioning a suitable base material so that it is relatively stiffer in one direction than in the perpendicular direction, to create the base; applying adhesive to the base to create an attachment assembly; putting a removal tab at one end of the resulting piece; selecting a liner material and cutting it to size; and then applying liners over both sides of the attachment assembly. The base of the conjoiner must be dimensioned or made of a material which is stiffer in one direction than the other, the stiffer direction being aligned vertically, thereby preventing rolling, folding, or bunching of the material during use while allowing flexibility in the horizontal direction to give the desired wearing comfort. The removal tab eases the process of getting a grip on the liners and facilitates the initiation of a peeling motion when removing the liners; it also makes it easy to remove the attachment assembly after use.

The invention is intended to join two articles of clothing such as, but not limited to, trousers and a shirt, slacks and a blouse, skirt and a blouse, and shorts and a shirt. Other objects will become apparent to one skilled in the art through study of this disclosure.

DETAILED DESCRIPTION OF THE INVENTION

Figure 1:
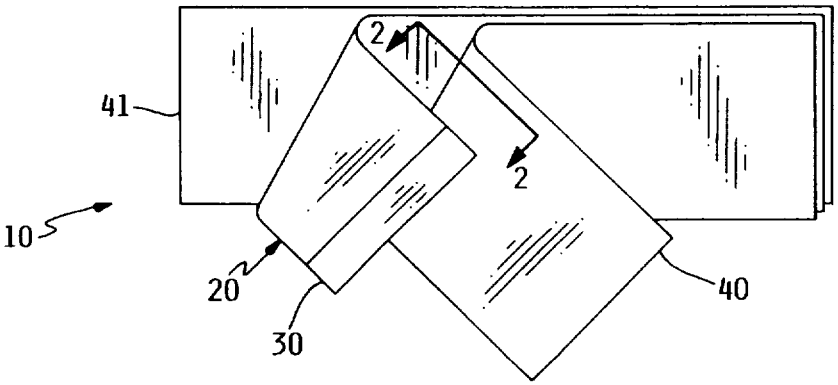
FIG. 1 is a side elevational view of a clothing conjoiner, in its orientation of normal use, with parts partially pulled back for illustrative purposes. The clothing conjoiner 10 made by this invention has three primary components, an attachment assembly 20, a removal tab 30, and liners 40 and 41.
Figure 2:
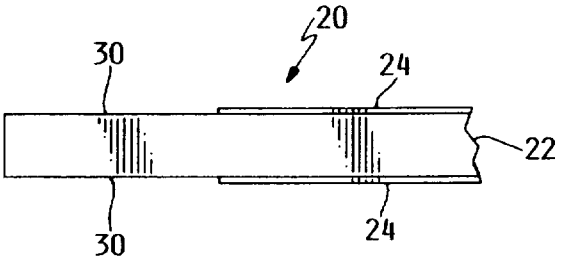
FIG. 2 is an edge view of an enlarged portion of the attachment assembly showing the removal tab. The removal tab 30 has, as components, a base 22, adhesive 24, and removal tab 30.
Figure 3:
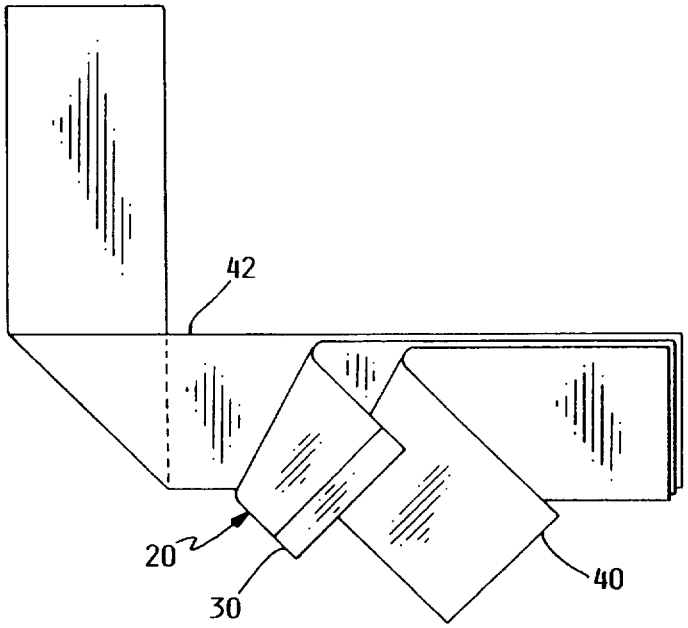
FIG. 3 is a side elevational view of the clothing conjoiner made by an alternative method of the invention. The completed product made by the alternative method of this invention has four primary components, the attachment assembly 20, the removal tab 30, an extended inner liner 42, and an outer liner 40.
Figure 4:
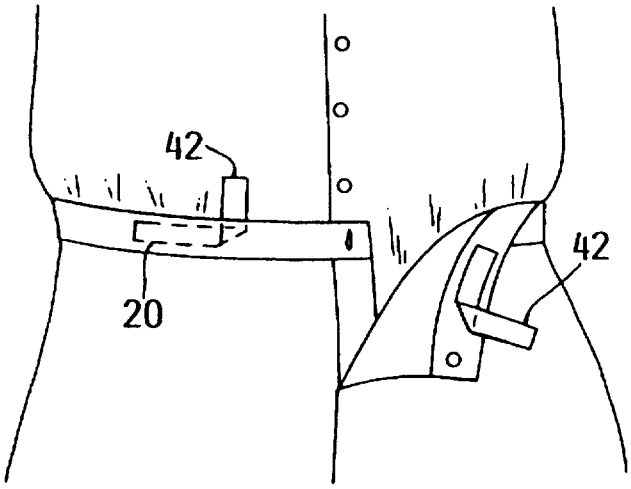
FIG. 4 is a view of the conjoiner applied to the outer garment by the alternative method of the invention.
Figure 5:
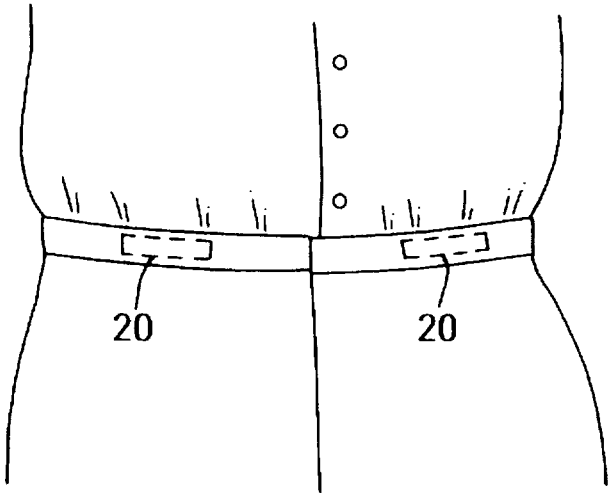
FIG. 5 is a view of the conjoiner which has been made and placed using the method of the invention.

This invention consists of a method for conjoining clothes. The primary step of the method is the creation of a suitable base, that being one which is dimensioned or made of a material so that it is relatively stiffer in one direction than it is in the perpendicular direction. This feature permits the conjoiner to be made so that it is relatively more stiff in the vertical direction, and thus will retain its shape and neither roll, fold, nor bunch when used to join the waistband of pants or a skirt to a shirt or blouse, while allowing flexibility in the horizontal direction to provide the desired wearing comfort.

The next step of the method is to dimension the base material so that it is narrower in the stiffer direction than in the perpendicular direction, creating the base. The base will be cut so as to be between one-quarter inch and two inches wide in the stiffer direction and between two and eight inches long in the more flexible direction. The shorter dimension of the conjoiner will be vertical and the longer dimension will be horizontal, running along the waistband, when the conjoiner is applied to the user's waistband.

A preferred method is to dimension the base to be between three-quarter inch and one and one-quarter inch in width and between three and six inches in length. One particular example is to dimension the base to be one inch wide and four inches long.

An adhesive must be selected for application to the base which has the qualities of being permanently attachable to the base material, which will be peelable from later-applied liner materials, and which will adequately grip, but be peelable from, articles of clothing.

The adhesive is then applied to both sides of the base to create an attachment assembly. A removal tab is created along one edge of the attachment assembly, either by excluding adhesive from the terminal end of the base or by attaching non-adhesive material to the end of the attachment assembly. The removal tab could also run along a portion of the top or bottom of the attachment assembly; these would work but are not the preferred locations.

One must next select a liner material which will have the qualities of adhering to the adhesive, but which will be easily peelable from the adhesive by the user.

Two pieces of the liner material, an outer liner and an inner liner, are then cut to substantially conform to the shape of the attachment assembly and are applied to each side of the attachment assembly.

An alternative method of the invention is to cut only the outer liner to substantially conform to the shape of the attachment assembly; this is then applied to one side of the attachment assembly to form the exterior of the conjoiner, that is, the portion which will be attached to the pants or skirt of the user.

In the alternative method, the inner liner is cut to a length greater than the length of the attachment assembly to create an extended inner liner; the excess length may be folded so that the extended inner liner extends vertically above and beyond the waistband for convenient removal of the extended inner liner after the clothing garments are in place.

The user takes the conjoiner and utilizes the removal tab on the attachment assembly to get a grip on the outer liner so he/she can remove the outer liner from the conjoiner, then applies the outer face of the adhesive coated attachment assembly to the interior of the waistband of pants or a skirt. The user then dons the pants or skirt and the shirt or blouse and adjusts the combination as he/she prefers. After adjustment, the user removes the inner liner from the inner face of the conjoiner and pats the clothing to create bonding between the attachment assembly and the shirt or blouse.

I claim:

1. A method for conjoining clothes which comprises:

a) selecting a base material and dimensioning it so that it is relatively stiffer in one direction than in the direction perpendicular to it;

b) cutting the base material so that it is narrower in the stiffer direction than in the perpendicular direction, to create a base;

c) selecting an adhesive with the qualities of being
(1) permanently attachable to the base material,
(2) peelable from later-applied liner materials, and
(3) gripping to but peelable from clothing fabrics;

d) applying the adhesive to both sides of the base to create an attachment assembly;

e) creating a removal tab along one edge of the attachment assembly;

f) selecting a liner material which will adhere to the adhesive until removed by the user, and which will be easily peelable from the adhesive by the user;

g) cutting two pieces of the liner material, wherein
(1) one piece of the liner material is cut to substantially conform to the shape of the attachment assembly to create the outer liner;
(2) a second piece of the liner material is cut to the width of the attachment assembly and to a length greater than that of the attachment assembly to create the inner liner; and h) applying the inner liner to one side of the attachment assembly and applying the outer liner to the other side of the attachment assembly to create a complete conjoiner;

i) folding the excess length of inner liner upward in a direction perpendicular to the length of the attachment assembly so as to form an exposure tab to allow for ease of removal of the inner liner after the conjoined garments are in place on the user;

j) taking the conjoiner and utilizing the removal tab on the attachment assembly to get a grip on the outer liner to remove the outer liner from the conjoiner;

k) applying the adhesive coated attachment assembly to the interior of the waistband of pants or a skirt;

l) donning the pants or skirt and the shirt or blouse and adjusting the combination as preferred;

m) removing the inner liner, employing the exposure tab, from the inner face of the conjoiner and patting the clothing to create bonding between the attachment assembly and the shirt or blouse.

2. The method of claim 1, wherein the base has a dimension of between one-quarter inch and two inches in the stiffer direction and a dimension of between two inches and eight inches in the more flexible direction.

3. The method of claim 1, wherein the base has a dimension of between three-quarter inch and one and one-quarter inch in the stiffer direction and a dimension of between three inches and six inches in the more flexible direction.

4. The method of claim 1, wherein the base has a dimension of one inch in the stiffer direction and a dimension of four inches in the more flexible direction.

5. A method for conjoining clothes which comprises:

a) selecting a base material and dimensioning it so that it is relatively stiffer in one direction than in the direction perpendicular to it;

b) cutting the base material so that it is narrower in the stiffer direction than in the perpendicular direction, to create a base;

c) selecting an adhesive with the qualities of being
(1) permanently attachable to the base material,
(2) peelable from later-applied liner materials, and
(3) gripping to but peelable from clothing fabrics;

d) applying the adhesive to both sides of the base to create an attachment assembly;

e) creating a removal tab along one edge of the attachment assembly;

f) selecting a liner material which will adhere to the adhesive until removed by the user, and which will be easily peelable from the adhesive by the user;

g) cutting two pieces of the liner material, wherein (1) one piece of the liner material is cut to substantially conform to the shape of the attachment assembly to create the outer liner;

(2) a second piece of the liner material is cut to the width of the attachment assembly and to a length greater than that of the attachment assembly to create the inner liner; and h) applying the inner liner to one side of the attachment assembly and applying the outer liner to the other side of the attachment assembly to create a complete conjoiner;

i) folding the excess length of inner liner upward in a direction perpendicular to the length of the attachment assembly so as to form an exposure tab to allow for ease of removal of the inner liner after the conjoined garments are in place on the user;

j) taking the conjoiner and utilizing the removal tab on the attachment assembly to get a grip on the outer liner to remove the outer liner from the conjoiner;

k) applying the adhesive coated attachment assembly to the interior of the waistband of pants or a skirt;

l) donning the pants or skirt and the shirt or blouse and adjusting the combination as preferred;

m) removing the inner liner, employing the exposure tab, from the inner face of the conjoiner and patting the clothing to create bonding between the attachment assembly and the shirt or blouse.

j) taking the conjoiner and utilizing the removal tab on the attachment assembly to get a grip on the outer liner to remove the outer liner from the conjoiner;

k) applying the adhesive coated attachment assembly to the interior of the waistband of pants or a skirt;

l) donning the pants or skirt and the shirt or blouse and adjusting the combination as preferred;

m) removing the inner liner, employing the exposure tab, from the inner face of the conjoiner and patting the clothing to create bonding between the attachment assembly and the shirt or blouse.

* * * * *

UNITED STATES PATENT AND TRADEMARK OFFICE

CERTIFICATE OF CORRECTION

PATENT NO. : 5,515,544
DATED : May 14, 1996
INVENTOR(S) : Louis R. Hosking

It is certified that error appears in the above-indentified patent and that said Letters Patent is hereby corrected as shown below:

At line 9 of column 4, add --and-- after ";".

At line 13 of column 4, delete "and".

At line 18 of column 4, insert --the-- between "of" and "inner".

At line 3 of column 5, add --and-- after ";".

At line 7 of column 5, delete "and".

At line 12 of column 5, insert --the-- between "of" and "inner".

At lines 12 through 14 of column 5, delete "upward in a direction perpendicular to the length of the attachment assembly".

Delete lines 7 through 17 of column 6.

Signed and Sealed this

Twenty-third Day of July, 1996

*Attest:*

Bruce Lehman

BRUCE LEHMAN

*Attesting Officer*

*Commissioner of Patents and Trademarks*